US006607618B1

(12) United States Patent
Manning et al.

(10) Patent No.: US 6,607,618 B1
(45) Date of Patent: Aug. 19, 2003

(54) PROPELLANT COMPOSITIONS

(75) Inventors: Thelma G. Manning, Montville, NJ (US); Joseph L. Prezelski, Montville, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 173 days.

(21) Appl. No.: 09/649,634

(22) Filed: Aug. 28, 2000

(51) Int. Cl.[7] ..... C06B 31/00; C06B 25/18

(52) U.S. Cl. ..... 149/45; 149/96

(58) Field of Search ..... 149/45, 96

(56) References Cited

U.S. PATENT DOCUMENTS 3,779,820 A * 12/1973 Stevely et al. ..... 149/2
3,811,358 A * 5/1974 Morse ..... 86/20
3,890,175 A * 6/1975 Lavitt ..... 149/92
4,092,188 A * 5/1978 Cohen et al. ..... 149/19.4
4,102,953 A * 7/1978 Johnson et al. ..... 264/3
4,627,352 A * 12/1986 Brachert et al. ..... 102/290
4,724,017 A * 2/1988 Eich et al. ..... 149/11
5,520,756 A * 5/1996 Zeigler ..... 149/19.8
6,121,506 A * 9/2000 Abel et al. ..... 588/200

* cited by examiner

*Primary Examiner*—Michael J. Carone
*Assistant Examiner*—Aileen B. Felton
(74) *Attorney, Agent, or Firm*—Robert Charles Beam; John F. Moran

(57) ABSTRACT

The present invention shows a munitions propellant. The propellant has a nitrocellulose component is about fifty-two percent (52.0%) of the propellant. This is either a nitrocellulose having twelve and six-tenths percent (12.6%) nitrogen, or a combination of a nitrocellulose having twelve and six-tenths percent (12.6%) nitrogen and a nitrocellulose having thirteen and thirty-five one hundredths percent (13.35%) nitrogen, and in which the average nitrogen proportion is thirteen and five one-hundredths percent (13.05%).

The propellant also has a nitroester-based plasticizer and a non-nitroester-based plasticizer. The nitroester-based plasticizer comprises about thirty-four percent (34.0%) of the propellant by weight, and comprises diethylene glycol dinitrate (DEGDN). The non-nitroester-based plastizier comprises from about three percent (3.0%) to about four percent (4.0%) by weight and comprises di-normal propyl adipate (DNPA). In addition, about seven percent (7.0%) of the propellant by weight of the composition is nitroguanidine (NQ).

7 Claims, No Drawings

PROPELLANT COMPOSITIONS

37 CFR 1.77 (a)(4) Cross Reference to related applications

None.

37 CFR 1.77 (a)(5) Statement regarding federally sponsored research or development The invention described herein may be made, used, or licensed by or for the United States Government for Governmental purposes without the payment of any royalties thereon or therefor.

37 CFR 1.77 (a)(7) BACKGROUND OF THE INVENTION

1. Field of the Invention

The present invention relates to a novel formulation for a munitions propellant. In particular, the present invention relates to a munitions propellant comprising:

- a nitrocellulose component comprising about fifty-two percent (52.0%) of the munitions propellant by weight, and comprising-a.nitrocellulose composition chosen from the group consisting of:
  - a nitrocellulose having a nitrogen proportion of twelve and six-tenths percent (12.6%) nitrogen, and
  - a combination of a nitrocellulose composition having a nitrogen proportion of twelve and six-tenths percent (12.6%) nitrogen and a nitrocellulose composition having a nitrogen proportion of thirteen and thirty-five one hundredths percent (13.35%), said combination having an average nitrogen proportion of thirteen and five one-hundredths percent (13.05%);
- a nitroester-based plasticizer component comprising from about thirty-four percent (34.0%) to about thirty-five percent (35.0%) of the munitions propellant by weight, and comprising diethylene glycol dinitrate (DEGDN);
- a burning rate temperature coefficient reducing component comprising about seven percent (7.0%) of the munitions propellant by weight, and comprising nitroguanidine (NQ); and,
- a non-nitroester-based plasticizer component comprising from about three percent (3.0%) to about four percent (4.0%) of the munitions propellant by weight, and comprising di-normal propyl adipate (DNPA).

2. Description of Related Art

Many energetic compositions are manufactured with, or contain, various compounds that may be hazardous from an environmental point of view, or even toxic. This is particularly true of certain munitions. The current M14 formulation contains toxic and hazardous materials including dinitrotoluene (DNT), dibutylphthalate (DBP), and diphenylamine (DPA). Diphenylamine (DPA) is classified as a highly toxic material, dibutylphthalate (DBP) is a suspected carcinogen, and a Department of Health and Human Services study has linked exposure to dinitrotoluene (DNT) with increased liver, bile duct and gall bladder cancers.

Removing these toxic components from the manufacture of M14 munitions would be a great improvement in the health and safety of the workers preparing such munitions. Another important step would be eliminating the need for solvents in the manufacturing process. This would eliminate many environmental concerns. A new formulation that would permit both the removal of toxic components and eliminate the need for the use of solvents in the manufacturing process would be a great step forward. There has existed a need to address these health and environmental hazards and make both the manufacturing and use of M14 propellant munitions both safer and more environmentally friendly.

At the same time, there are some disadvantages with the current M14 formulation that make it disadvantageous in use, and if these could also be addressed, a new propellant formula would have a distinct IM advantage. One such problem is the susceptibility of the current M14 propellant formulation to a kinetic energy penetrator. The nitrocellulose-based propellants of the prior art met the propellant requirements for M865, M831, and MPAT training rounds that uses the current M14 propellant and have been in use for some time. However, this prior art formulation remains subject to a kinetic energy penetrator, and this has created a greater risk in the event of a training accident.

37 CFR 1.77 (a)(8) BRIEF SUMMARY OF THE INVENTION

OBJECTS OF THE PRESENT INVENTION

It is an object of the present invention to provide a propellant formulation that does not employ toxic components.

It is a further object of the present invention to provide a propellant formulation that may be produced without the use of solvents.

It is a still further object of the present invention to provide a propellant formulation that is less sensitive to kinetic energy penetration.

The other objects, features and advantages of the present invention will become more apparent in light of the following detailed description of the preferred embodiment thereof.

SUMMARY OF THE PRESENT INVENTION

According to a preferred embodiment of the present invention, there is provided a munitions propellant comprising:

- a nitrocellulose component comprising about fifty-two percent (52.0%) of the munitions propellant by weight, and comprising a nitrocellulose composition chosen from the group consisting of:
  - a nitrocellulose having a nitrogen proportion of twelve and six-tenths percent (12.6%) nitrogen, and
  - a combination of a nitrocellulose composition having a nitrogen proportion of twelve and six-tenths percent (12.6%) nitrogen and a nitrocellulose composition having a nitrogen proportion of thirteen and thirty-five one hundredths percent (13.35%), said combination having an average nitrogen proportion of thirteen and five one-hundredths percent (13.05%);
- a nitroester-based plasticizer component comprising from about thirty-four percent (34.0%) to about thirty-five percent (35.0%) of the munitions propellant by weight, and comprising diethylene glycol dinitrate (DEGDN);
- a burning rate temperature coefficient reducing component comprising about seven percent (7.0%) of the munitions propellant by weight, and comprising nitroguanidine (NQ); and,
- a non-nitroester-based plasticizer component comprising from about three percent (3.0%) to about four percent (4.0%) of the munitions propellant by weight, and comprising di-normal propyl adipate (DNPA).

37 CFR 1.77 (a)(10) DETAILED DESCRIPTION OF THE INVENTION

The present invention is the result of a program to develop a suitable replacement for the present formulation employed as a propellant in M14 projectiles. To be acceptable as a replacement formulation, however, a new formulation should maintain the performance characteristics of the existing formulation while, eliminating or significantly reducing the problems associated with the current formulation.

Perhaps the most pressing of the problems associated with the current formulation is the use of composition components for which significant health problems have been demonstrated. In this regard, diphenylamine (DPA) is classified as a highly toxic material, dibutylphathalate (DBP) is a suspected carcinogen, and workers exposed to dinitrotoluene (DNT) have been shown to have a 2.5 times greater likelihood to have liver, bile duct, and gall bladder cancers. Increased controls and workplace limitations can be expected on all of these compounds.

In addition, the manufacture of the current M14 formulation, like many energetic compositions, still involves the use of organic solvents. This creates an environmental issue, since environmental regulations increasingly limit the release of organic solvents, and capture of off-gased solvents creates a diseconomy in the manufacturing process. Any reformulation of the propellant material employed in M14 cartridges should address the environmental impact of the reformulated materials.

Finally, as noted previously, the current formulation for M14 propellant meets the current requirements for M14 performance. Typical performance numbers for the prior art M14 formulation are given in Table 1 below, but include a density of 1.594 grams per cubic centimeter (g/cc), a flash temperature of 2757 degrees Kelvin (° K.), and an Impetus of 995 joules per gram (J/gm.). There are, however, some characteristics that could be improved. This is particularly true of its kinetic energy penetration characteristics. The nitrocellulose-based propellant formulation currently in use tends to work harden in processing and become brittle. In order to decrease the propellant sensitivity to training round impact, the propellant brittleness must be reduced. In the present invention, this has been accomplished by lowering the nitrogen content of the nitrocellulose and by plasticization of the materials.

In the formulation of Example A, the average nitrogen content of the nitrocellulose has been reduced to thirteen and five one-hundredths percent nitrogen by utilizing a mixture of nitrocellulose sources. This formulation utilizes a mixture of a nitrocellulose with a nitrogen content of thirteen and thirty-five one-hundredths percent (13.35%) and a nitrocellulose with a nitrogen content of twelve and six-tenths percent (12.6%) nitrogen. Along with this nitrocellulose mixture, a nitroester-based energetic plastizer, diethylene glycol dinitrate (DEGDN) and a non-nitroester based plasticizer, di-normal propyl adipate (DNPA), are employed, which results in a propellant which is far less brittle.

The formulation of Example B, goes a bit further in reducing the brittleness of the formulation by employing only a nitrocellulose with a nitrogen level of twelve and six-tenths percent (12.6%) nitrogen. This nitrocellulose is plasticized with diethylene glycol dinitrate (DEGDN) and di-normal propyl adipate (DNPA).

Di-normal propyl adipate (DNPA) was employed, in addition to the nitroester plasticizer diethylene glycol dinitrate (DEGDN), because of its superior performance at low temperatures, and nitroguanidine (NQ) was employed in both formulations to assist in maintaining the low temperature performance coefficients.

Small proportions of additional additives were also employed in the formulations for various purposes. For example, a small amount of wax was added as a processing aid, and graphite was added to the formulations to make the propellant material conductive and therefor safer to handle. Potassium Sulfate was added to reduce muzzle flash in the finished propellant.

EXAMPLE A

A nominal ten-pound quantity of test formulation was prepared in the following manner. A quantity of water-wet nitrocellulose having a nitrogen content of twelve and six-tenths percent (12.6%) nitrogen and a calculated dry weight of eleven hundred eight and thirty-six one hundredths grams (1108.36 g.) was worked to loosen the nitrocellulose fibers and stored to keep the water content uniform. At the same time, a quantity of water-wet nitrocellulose having a nitrogen content of thirteen and thirty-five one-hundredths (13.35%) nitrogen and a calculated dry weight of sixteen hundred sixty-two and fifty-four grams (1662.54 g.) was worked to loosen the nitrocellulose fibers and stored to keep the water content uniform.

Other materials were prepared as follows. A small quantity of candelilla wax, a refined vegetable wax of natural origin, having a dry weight of six and eighty-one one-hundredths grams (6.81 g.) was pulverized and ground in a mortar with a pestle. A pre-dissolved plasticizer/stabilizer mixture was made of the following ingredients:

- a quantity of diethylene glycol dinitrate (DEGDN) having a dry weight of seventeen hundred eighty-eight and seventy-six one-hundredths grams (1788.76
- a quantity of di-normal propyl adipate (DNPA) having a dry weight of one hundred eighty-one and sixty one-hundredths grams (81.60 g.); and,
- a quantity of diethyl diphenyl urea, having a trade designation of ethyl centralite (EC), having a dry weight of seventy-two and sixty-four one-hundredths grams (72.64 g.).

The two quantities of nitrocellulose and the candelilla wax were added to a slurry mixing tank, together with a small quantity of graphite, in the form of carbon black, having a dry weight of two and twenty-seven one-hundredths grams (2.27 g.). To this, the previously prepared plasticizer/stabilizer mixture was added. Then, a quantity of nitroguanidine (NQ) having a dry weight of three hundred seventeen and eighty one-hundredths grams (317.80 g.) and a quantity of potassium sulfate having a dry weight of thirty-six and thirty-two one-hundredths grams (36.32 g.) were added. Together these materials were mixed for a total of thirty-one (31) minutes in the slurry tank. Later, an additional small quantity of graphite having a dry weight of four and fifty-four one-hundredths grams (4.54 g.) was added as a glaze.

The resulting slurry was de-watered by centrifuging at 450 revolutions per minute for two minutes. The paste that resulted was aged for five days at one hundred and thirty degrees Fahrenheit (130° F.) and then dried for five days at one hundred and thirty degrees Fahrenheit (130° F.) to a final moisture content of approximately fourteen percent (14%). The material was then blended for fifteen minutes (15 min.) with larger lumps being broken up by hand as necessary.

The material was then subjected to rolling treatments. The first step was to roll the material in a Differential Speed (DS) Roll. The equipment was set at one hundred and ninety degrees Fahrenheit (190° F.) with one roller set at twenty-two and one-half revolutions per minute (22.5 rpm) in the backward direction and the other roller set at fifteen revolutions per minute (15.0 rpm) in the forward direction. The gap was set at thirty-six thousands of an inch (0.036 in.), the charge weight was six hundred and seventy grams (670 g.), and the rolling time was two and one-half minutes (2.5 min.).

The material was then rolled in an Even Speed Roller with the equipment heated to between one hundred and-forty-five degrees Fahrenheit (145° F.) and one hundred and fifty-five degrees Fahrenheit (155° F.). Both rollers were set at ten revolutions per minute (10 rpm), and the gap was set at fifty-five thousands of an inch (0.055 in.). The material was passed through the Even Speed Roll six times, with the first pass being a marriage of the two sheets prepared in the Differential Speed Roll, four bookfold passes, and a final double long pass.

The sheeted material was then placed on a steam table and heated at between one hundred forty-five degrees Fahrenheit (145° F.) and one hundred fifty-four degrees Fahrenheit (154° F.). It was then cut into strips four inches (4 in.) wide which were then wrapped into a carpet roll with a diameter of approximately four inches (4 in.). These were heated overnight at the same temperature and loaded into a Farquhar press. Under vacuum at between one hundred and sixty degrees Fahrenheit (160° F.) and one hundred and seventy degrees Fahrenheit (170° F.) the material was cut to one inch (1 in.). It was then stamped with a single perforation die having a die diameter of twenty-eight hundred and thirty ten-thousands of an inch (0.2830 in.) and a pin diameter of one thousand and thirty-five ten-thousandths of an inch (0.1035 in.). The material was then dried at ambient temperature and pressure for one day.

Performance results for this material are given in Table 1 but include a density of 1.5034 grams per cubic centimeter (g/cc), a flash temperature of 2660 degrees Kelvin (° K.), and an Impetus of 1010 joules per gram (J/gm.).

EXAMPLE B

A nominal ten-pound quantity of test formulation was prepared in the following manner. A quantity of water-wet nitrocellulose having a nitrogen content of twelve and six-tenths percent (12.6%) nitrogen and a calculated dry weight of twenty-seven hundred seventy-six and twenty-two one hundredths grams (2776.22 g.) was worked to loosen the nitrocellulose fibers and stored to keep the water content uniform.

Other materials were prepared as follows. A small quantity of candelilla wax, a refined vegetable wax of natural origin, having a dry weight of six and eighty-one one-hundredths grams (6.81 g.) was pulverized and ground in a mortar with a pestle. A pre-dissolved plasticizer/stabilizer mixture was made of the following ingredients:

- a quantity of diethylene glycol dinitrate (DEGDN) having a dry weight of eighteen hundred eleven and forty-six one-hundredths grams (1811.46 g.);
- a quantity of di-normal propyl adipate (DNPA) having a dry weight of one hundred forty-nine and eighty-two one-hundredths grams (149.82 g.); and,
- a quantity of diethyl diphenyl urea, having a trade designation of ethyl centralite (EC), having a dry weight of seventy-two and sixty-four one-hundredths grams (72.64 g.).

The nitrocellulose and the candelilla wax were added to a slurry mixing tank, together with a small quantity of graphite, in the form of carbon black, having a dry weight of two and twenty-seven one-hundredths grams (2.27 g.). To this, the previously prepared plasticizer/stabilizer mixture was added. Then, a quantity of nitroguanidine (NQ) having a dry weight of three hundred seventeen and eighty one-hundredths grams (317.80 g.) and a quantity of potassium sulfate having a dry weight of forty and eighty-six one-hundredths grams (40.86 g.) were added. Together these materials were mixed for a total of thirty-one (31) minutes in the slurry tank. Later, an additional small quantity of graphite having a dry weight of four and fifty-four one-hundredths grams (4.54 g.) was added as a glaze.

The resulting slurry was de-watered by centrifuging at 450 revolutions per minute for two minutes. The paste that resulted was aged for five days at one hundred and thirty degrees Fahrenheit (130° F.) and then dried for five days at one hundred and thirty degrees Fahrenheit (130° F.) to a final moisture content of approximately fourteen percent (14%). The material was then blended for fifteen minutes (15 min.) with larger lumps being broken up by hand as necessary.

The material was then subjected to rolling treatments. The first step was to roll the material in a Differential. Speed (DS) Roll. The equipment was set at one hundred and ninety degrees Fahrenheit (190° F.) with one roller set at twenty-two and one-half revolutions per minute (22.5 rpm) in the backward direction and the other roller set at fifteen revolutions per minute (15.0 rpm) in the forward direction. The gap was set at thirty-six thousands of an inch (0.036 in.), the charge weight was six hundred and seventy grams (670 g.), and the rolling time was two and one-half minutes (2.5 min.).

The material was then rolled in an Even Speed Roller with the equipment heated to between one hundred and forty-five degrees Fahrenheit (145° F.) and one hundred and fifty-five degrees Fahrenheit (155° F.). Both rollers were set at ten revolutions per minute (10 rpm), and the gap was set at fifty-five thousands of an inch (0.055 in.). The material was passed through the Even Speed Roll six times, with the first pass being a marriage of the two sheets prepared in the Differential Speed Roll, four bookfold passes, and a final double long pass.

The sheeted material was then placed on a steam table and heated at between one hundred forty-five degrees Fahrenheit (145° F.) and one hundred fifty-four degrees Fahrenheit (154° F.). It was then cut into strips four inches (4 in.) wide which were then wrapped into a carpet roll with a diameter of approximately four inches (4 in.). These were heated overnight at the same temperature and loaded into a Farquhar press. Under vacuum at between one hundred and sixty degrees Fahrenheit (160° F.) and one hundred and seventy degrees Fahrenheit (170° F.) the material was cut to one inch (1 in.). It was then stamped with a single perforation die having a die diameter of twenty-eight hundred and thirty ten-thousands of an inch (0.2830 in.) and a pin diameter of one thousand and thirty-five ten-thousandths of an inch (0.1035 in.). The material was then dried at ambient temperature and pressure for one day.

Performance results for this material are given in Table 1, but include a density of 1.52 grams per cubic centimeter (g/cc), a flash temperature of 2669 degrees Kelvin (° K.), and an Impetus of 995.2 joules per gram (J/gm.).

TABLE 1

| | Prior M14 Formulation | Example A Formulation | Example B Formulation |
|---|---|---|---|
| Formula: | | | |
| Nitrocellulose 13.35% Nitrogen | 90 | | |
| Nitrocellulose 13.05% Nitrogen | | 52 | |
| Nitrocellulose 12.6% Nitrogen | | | 52.1 |
| Dibutylphathalate (DBP) | 1.95 | | |
| Dinitrotoluene (DNT) | 7.82 | | |
| Diethylene glycol dinitrate (DEGDN) | | 34.4 | 34.9 |
| Di-normal propyl adipate (DNPA) | | 4.0 | 3.3 |
| Nitroguanidine (NQ) | | 7.0 | 7.0 |
| Graphite | | 0.15 | 0.15 |
| Potassium Sulfate | | 0.80 | 0.90 |
| Ethyl Centralite (EC) | 0.98 | 1.60 | 1.60 |
| Candelilla wax | | 0.15 | 0.15 |
| Ethanol | 1.00 | | |
| Water | 0.25 | | |
| Performance: | | | |
| Flash Temperature (° Kelvin) | 2758 | 2660 | 2669 |
| Density (g/cc) | 1.594 | 1.5034 | 1.52 |
| Impetus (J/gm) | 995 | 1010 | 995.2 |

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. A munitions propellant comprising:

a nitrocellulose component comprising about fifty-two percent (52.0%) of the munitions propellant by weight, and comprising a nitrocellulose composition chosen from the group consisting of:

a nitrocellulose having a nitrogen proportion of twelve and six-tenths percent (12.6%) nitrogen, and a combination of a nitrocellulose composition having a nitrogen proportion of twelve and six-tenths percent (12.6%) nitrogen and a nitrocellulose composition having a nitrogen proportion of thirteen and thirty-five one hundredths percent (13.35%), said combination having an average nitrogen proportion of thirteen and five one-hundredths percent (13.05%);

a nitroester-based plasticizer component comprising from about thirty-four percent (34.0%) to about thirty-five percent (35.0%) of the munitions propellant by weight, and comprising diethylene glycol dinitrate (DEGDN);

a burning rate temperature coefficient reducing component comprising about seven percent (7.0%) of the munitions propellant by weight, and comprising nitroguanidine (NQ); and, a non-nitroester-based plasticizer component comprising from about three percent (3.0%) to about four percent (4.0%) of the munitions propellant by weight, and comprising di-normal propyl adipate (DNPA).

2. The munitions propellant of claim 1, comprising:

a nitrocellulose component comprising about fifty-two percent (52.0%) of the munitions propellant by weight, and comprising a combination of a nitrocellulose composition having a nitrogen proportion of twelve and six-tenths percent (12.6%) nitrogen and a nitrocellulose composition having a nitrogen proportion of thirteen and thirty-five one hundredths percent (13.35%), said combination having an average nitrogen proportion of thirteen and five one-hundredths percent (13.05%);

a nitroester-based plasticizer component comprising about thirty-four and four-tenths percent (34.4%) of the munitions propellant by weight, and comprising diethyl glycol nitrate (DEGDN);

a burning rate temperature coefficient reducing component comprising from about seven percent (7.0%) of the munitions propellant by weight, and comprising nitroguanidine (NQ); and, a non-nitroester-based plasticizer component comprising about four percent (4.0%) of the munitions propellant by weight, and comprising di-normal propyl adipate (DNPA).

3. The munitions propellant of claim 1, comprising:

a nitrocellulose component comprising about fifty-two and one-tenth percent (52.1%) of the munitions propellant by weight, and comprising a nitrocellulose having a nitrogen proportion of twelve and six-tenths percent (12.6%) nitrogen;

a nitroester-based plasticizer component comprising about thirty-four and nine-tenths percent (34.9%) of the munitions propellant by weight of the composition, and comprising diethylene glycol dinitrate (DEGDN);

a burning rate temperature coefficient reducing component comprising about seven percent (7.0%) of the munitions propellant by weight, and comprising nitroguanidine (NQ); and, a non-nitroester-based plasticizer component comprising about three and three-tenths percent (3.3%) of the munitions propellant by weight, and comprising di-normal propyl adipate (DNPA).

4. The munitions propellant of claim 1, further comprising: from about one-tenth of one percent (0.1%) to about two-tenths of one percent (0.2%) of the munitions propellant by weight, and comprising graphite.

5. The munitions propellant of claim 1, further comprising: from about one-half of one percent (0.5%) to about one percent (1.0%) of the munitions propellant by weight, and comprising potassium sulfate.

6. The munitions propellant of claim 1, further comprising: a stabilizer component comprising about one and one-half percent (1.5%) to about two percent (2.0%) of the munitions propellant by weight, and comprising ethyl centralite (EC).

7. The munitions propellant of claim 1, further comprising: about one-tenth of one percent (0.1%) to about two-tenths of one percent (0.2%) of the munitions propellant by weight, and comprising candelilla wax.

* * * * *